US007011921B2

(12) United States Patent
Koeda et al.

(10) Patent No.: US 7,011,921 B2
(45) Date of Patent: Mar. 14, 2006

(54) METHOD AND APPARATUS FOR PRODUCING TONER FOR ELECTROPHOTOGRAPHY

(75) Inventors: Junya Koeda, Numazu (JP); Kenichi Uehara, Susono (JP); Hiroyuki Yoshikawa, Numazu (JP); Osamu Kouzu, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 64 days.

(21) Appl. No.: 10/638,525

(22) Filed: Aug. 12, 2003

(65) Prior Publication Data

US 2004/0097623 A1 May 20, 2004

(30) Foreign Application Priority Data

Aug. 12, 2002 (JP) ..... 2002-234643

(51) Int. Cl.
*G03G 5/00* (2006.01)

(52) U.S. Cl. ..... 430/137.1; 430/137.21

(58) Field of Classification Search ..... 430/137.1, 430/137.12

See application file for complete search history.

(56) References Cited

U.S. PATENT DOCUMENTS 4,900,647 A 2/1990 Hikake et al.

5,350,657 A 9/1994 Anno et al.

FOREIGN PATENT DOCUMENTS

| | | |
|---|---|---|
| EP | 1 207 432 | 5/2002 |
| JP | 63-085756 | 4/1988 |
| JP | 63-139366 | 6/1988 |
| JP | 05-034971 | 2/1993 |
| JP | 10-010781 | 1/1998 |
| JP | 10-095855 | 4/1998 |
| JP | 2000-267354 | 9/2000 |

OTHER PUBLICATIONS

Patent Abstracts of Japan, JP 08-173783, Jul. 9, 1996.

*Primary Examiner*—Mark A. Chapman
(74) *Attorney, Agent, or Firm*—Oblon, Spivak, McClelland, Maier & Neustadt, P.C.

(57) ABSTRACT

A method of producing a toner composition, including stirring and mixing toner particles comprising a binder resin, a colorant and a release agent with a charge controlling agent in a fluidizing and stirring mixer comprising a rotor having a stirring blade to fix the charge controlling agent on a surface of the toner particles, wherein the stirring and mixing comprises rotating the rotor at a peripheral speed of from 65 to 120 m/s at an environmental temperature (T) in the fluidizing and stirring mixer, satisfying the relationship, Tg-10>T>Tg-35(° C.), where the Tg represents a glass transition temperature of the binder resin.

11 Claims, 4 Drawing Sheets

METHOD AND APPARATUS FOR PRODUCING TONER FOR ELECTROPHOTOGRAPHY

BACKGROUND OF THE INVENTION

1. Field of the Invention

The present invention relates to a method and an apparatus for producing a toner for electrophotography.

2. Discussion of the Background

Conventionally, image forming apparatuses such as copiers and printers are required to produce higher quality images, and therefore a toner for forming an image has smaller particle diameter and is required to have fluidity and uniform chargeability. Accordingly, various methods of adding, mixing and efficiently adhering various external additives on a surface of a mother toner powder are suggested.

For example, Japanese Laid-Open Patent Publication No. 63-85756 discloses a method of adhering fine particles on a surface of a core material with a mechanical heat energy principally involving an impact force; Japanese Laid-Open Patent Publication No. 63-139366 discloses a method of removing a fine powder which is not adhered after mixing and adhering the fine powder; Japanese Laid-Open Patent Publication No. 10-10781 discloses a method of firmly adhering a surface treatment agent upon application of an instant heat; and Japanese Laid-Open Patent Publication No. 10-95855 discloses a method of uniformly adhering a surface treatment agent on a mother toner particle with a spheric mixer rotating two blades at a high speed.

Namely, in order to firmly adhere a surface treatment agent on a surface of a mother toner particle, a method of strengthening an impact force while softening the surface of the mother toner particle upon application of heat or a method of aggressively heating a resin surface of the mother toner particle without using the impact force is available. In addition, particles which are not adhered tend to be present in these methods.

Further, recent toners for electrophotographies have lower temperature fixability, and binder resins having a low glass transition temperature are preferably used in the toners. In addition, materials having a low melting point is included in toners for electrophotographies in many cases such that the toners have releasability from image forming apparatuses.

When mother toner particles including a material having a low melting point and a binder resin having a low glass transition temperature are stirred and mixed with an external additive to adhere the external additive to the mother toner particles, the material having a low melting point begins to melt and the resultant toner properties deteriorate unless the mother toner particles are stirred and mixed at a temperature at which the toner or the material having a low melting point melts. In addition, the particles agglutinate each other due to anastomoses and have to newly be classified or removed, which is not efficient in producing a toner.

Japanese Laid-Open Patent Publication No. 2000-267354 discloses a method of adhering inorganic fine particles on a surface of a mother toner particle by stirring and mixing at comparatively a low temperature based on a standard temperature of a glass transition temperature of a binder resin included in the mother toner particle. Specifically, a Henschel mixer using a vertical and cylindrical tank stirs and mixes.

When a surface treatment agent is adhered to a mother toner particle as a fluidity auxiliary agent for the purpose of improving fluidity of the resultant toner, the mother toner particle needs to have concavity and convexity to firmly receive the surface treatment agent. Therefore, the surface treatment agent needs to be mixed and stirred with the mother toner particle so as to collide therewith by a proper impact force. Accordingly, a Henschel mixer or a high speed mixer having a vertical and cylindrical tank and a rotating blade rotating at comparatively a high peripheral speed is conventionally and preferably used. In the method disclosed in Japanese Laid-Open Patent Publication No. 2000-267354, such mixers are also used.

However, particularly when a surface treatment agent controlling a charge is used, not only the surface treatment agent is adhered to a mother toner particle but also a part or a whole of the surface treatment agent has to be uniformly buried on the surface of the mother toner particle to be firmly fixed thereon. A presence of a toner on which a surface treatment agent controlling a charge is insufficiently fixed impairs uniform friction charge of toners and causes an image stain called background development.

Therefore, the surface treatment agent and the mother toner particle have to be mixed at such a stirring speed as gives a sufficient impact force therebetween to fix the surface treatment agent on the mother toner particle.

Particularly when a surface of a mother toner particle including a material having a low melting point and a binder resin having a low glass transition temperature is treated with a surface treatment agent to aim at a charge control, the mother toner particle and surface treatment agent have to be mixed at a low temperature at which the material having a low melting point does not melt and given sufficient impact force therebetween such that the surface treatment agent is fixed on the surface of the mother toner particle.

Because a mixer such as a Henschel mixer and a high speed mixer usually has a flat bottom and a cylindrical wall, as FIG. 1 shows, an air turbulence is generated in the mixer when stirring at a high speed and a mother toner powder irregularly moves. Therefore, the mixer has a drawback that the powder not only stagnates on the bottom thereof but also tends to adhere on the cylindrical wall.

Further, it is difficult to sufficiently fix the surface treatment agent on the mother toner particle in the Henschel mixer or high speed mixer because a maximum peripheral speed of a rotating blade thereof is 40 m/sec in practical use.

A hybridizer for use in an impact method in a high speed air stream is known as a stirring mixer capable of rotating its blade at a higher speed than that of the Henschel mixer or high speed mixer. The stirring mixer can sufficiently fix the surface treatment agent on the mother toner particle, but does not have a sufficient cooling mechanism because of being originally used to mix two or more kinds of particles with a heat. Therefore, the stirring mixer cannot practically be used because an amount of the surface treatment agent has to be extremely small when a surface of a mother toner particle including a material having a low melting point and a binder resin having a low glass transition temperature is treated with the surface treatment agent at a low temperature at which the material having a low melting point does not melt.

Thus, conventional mixers cannot sufficiently stir and mix the surface treatment agent and mother toner particle particularly when a surface of the mother toner particle including a material having a low melting point and a binder resin having a low glass transition temperature is treated with the surface treatment agent at a low temperature at which the material having a low melting point does not melt. Surface treatment conditions of individual mother toner particle have unevenness and a mixture of the wholly surface-treated mother toner particle and partially surface-treated mother toner particle causes a charged amount unevenness of individual mother toner particle. Therefore, the resultant image has a stain called background development and an amount of a toner which is not used for forming images and collected increases.

In addition, a surface treatment agent is easily released from a toner when the surface treatment agent is not firmly adhered thereto, and damages a photoreceptor or deteriorates performance of a developer due to a carrier spent.

Methods of preparing a mother toner particle including at least a thermoplastic resin, a colorant, a release agent and optionally various additives include a pulverization method of kneading the thermoplastic resin, colorant, release agent and optionally various additives upon application of heat; pulverizing and classifying the kneaded mixture; and optionally repeating the pulverization and classification, and a polymerization method of polymerizing the thermoplastic resin, colorant and a charge controlling agent by dispersing them as a grease spot in a solvent, etc.

It is indispensable to uniformly fix a charge controlling agent on a toner powder prepared by the polymerization method to prepare a highly reliable toner because it is difficult to take the charge controlling agent in the grease spot.

However, it is quite significant to make the charge controlling agent present only close to the surface of the mother toner particle in terms of cost reduction because the charge controlling agent is expensive.

Because of these reasons, a need exists for a method of producing a toner in which a charge controlling agent is used as a surface treatment agent, mainly present closely to the surface of the mother toner particle and fully fulfills its function.

SUMMARY OF THE INVENTION

Accordingly, an object of the present invention is to provide a method of producing a toner for electrophotography, in which a charge controlling agent is uniformly fixed closely to and not released from a surface of the mother toner particle including a release agent having a low melting point, and in which the release agent does not melt and adhere to the surface of the mother toner particle and the mother toner particles do not agglutinate each other.

Another object of the present invention is to provide a method of producing a toner for electrophotography, which is uniformly charged and does not deteriorate a developer.

Briefly these objects and other objects of the present invention as hereinafter will become more readily apparent can be attained by a method of producing a toner composition, including:

stirring and mixing toner particles including at least a binder resin, a colorant and a release agent with a charge controlling agent in a fluidizing and stirring mixer including at least a rotor having a stirring blade to fix the charge controlling agent on a surface of the toner particles, wherein the rotor rotates at a peripheral speed of from 65 to 120 m/s at an environmental temperature (T) in the fluidizing and stirring mixer, satisfying the following relationship:

$$Tg-10>T>Tg-35(^\circ C.)$$

wherein Tg represents a glass transition temperature of the binder resin.

The mother toner particle is preferably stirred and mixed in the fluidizing and stirring mixer in an amount of from 0.2 to 0.7 times a capacity thereof.

In addition, the mother toner particle preferably has an average particle diameter of from 3 to 7.5 $\mu$m.

Further, the charge controlling agent preferably has a primary particle diameter of from 5 to 300 nm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
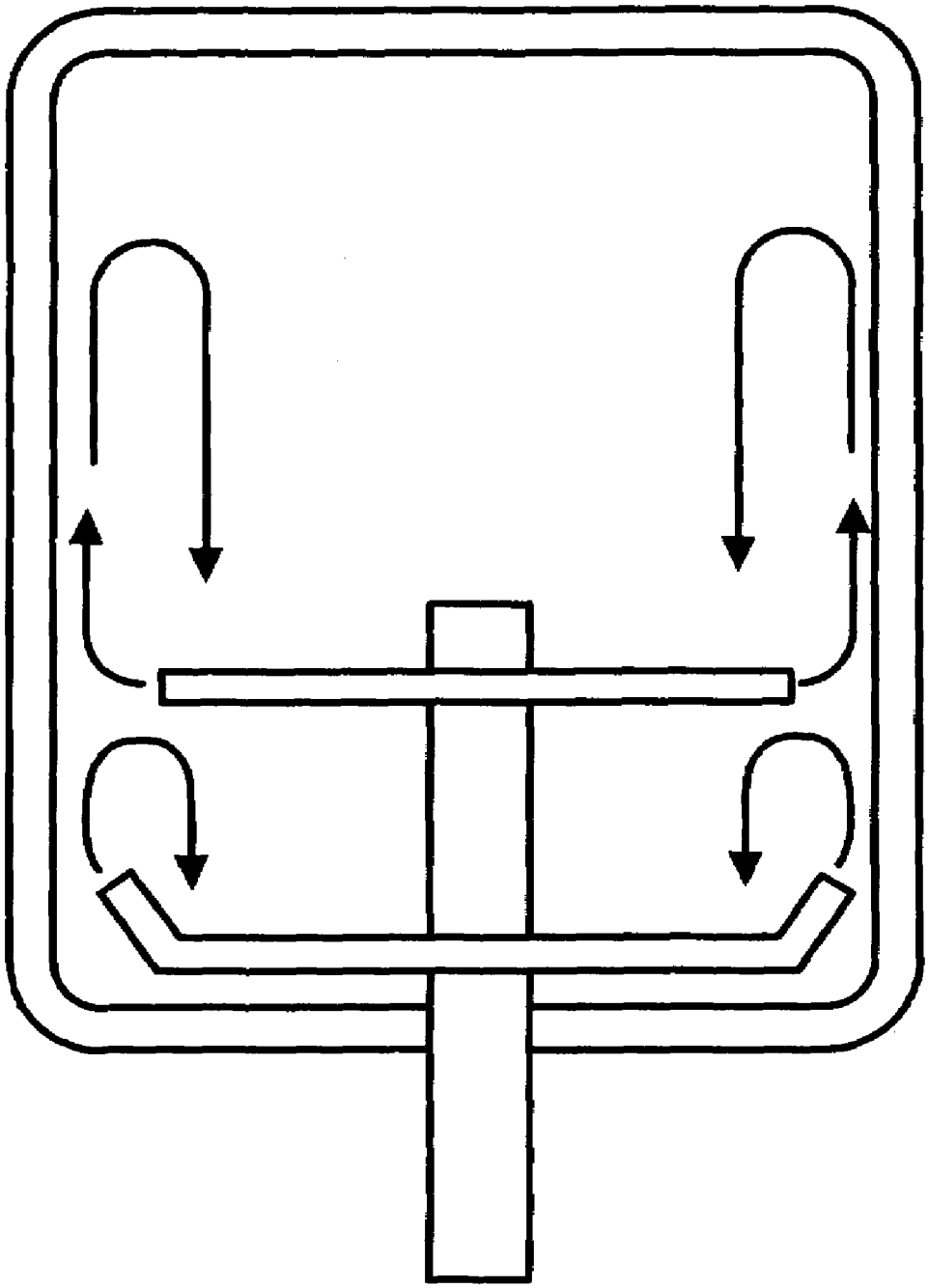
FIG. 1 is a schematic view illustrating a conventional vertical and cylindrical mixer.

Generally, the present invention provides a method of producing a toner, which includes stirring and mixing a mother toner particle including at least a binder resin, a colorant and a release agent with a charge controlling agent in a fluidizing and stirring mixer including at least a rotor having a stirring blade to uniformly adhere the charge controlling agent on a surface of the resin including the release agent at comparatively a low temperature, wherein the rotor rotates at a specified speed at a specified temperature (an environmental temperature) by a relationship with a glass transition temperature of the resin.

In accordance with low temperature fixation of a toner in the recent electrophotographic image forming process, the toner has a lower melting point and a resin having a glass transition temperature (Tg) of from 50 to 70° C. is preferably used for forming a mother toner particle. It is preferable to stir and mix a charge controlling agent with a resin powder at a temperature of from Tg-35 to Tg-10° C. to efficiently fix the charge controlling agent on the resin powder.

When the temperature is less than Tg-35° C., there is a case in which there is no heat due to collision between the stirring blade and powder or the powders themselves, i.e., the charge controlling agent is not sufficiently fixed on the resin powder. When the temperature is greater than Tg-10° C., an amount of heat is over a cooling capability of the mixer, and e.g., a release agent included in the resin powder particle of a toner for electrophotography is occasionally present on the surface of the particle.

Such a toner has a poor shelf life and contaminates the inside of an image forming apparatus. In addition, a material having a low melting point melts and forms an agglomeration of the toner needing to be classified and removed again, which is not efficient.

The fluidizing and stirring mixer having a stirring (peripheral) speed of from 65 to 120 m/s, and preferably from 70 to 100 m/s can give a large impact force to an individual particle, and further the particle hit by the impact force can move in the mixer at a high speed. A combination of these stirring and mixing conditions can effectively be used to stir and mix a surface treatment agent.

The fluidizing and stirring mixer for use in the present invention includes at least a rotor having plural blades at the bottom. The plural blades in a radial pattern like a bladed wheel are effectively used.

The rotor rotates to stir and mix a mother toner particle and a surface treatment agent particle such as a charge controlling agent in the mixer (hereinafter both particles are generically named a powder). The powder rides on an air current above the rotor and goes up to a top of the mixer along a wall thereof and comes down to a center of the rotor. In this circulation, the powder collides with each other, and consequently the surface treatment agent particle is adhered and fixed on the surface of the mother toner particle.

The present inventors proved that the surface treatment agent particle is fixed on the mother toner particle as desired when the powder goes to the wall in almost parallel with the rotor after colliding with the stirring blade and collides with the wall at a blunt angle.

Therefore, in the present invention, a stirrer generating such a powder circulation has to be used and the wall of the stirrer preferably has a spheric shape.

Figure 2:
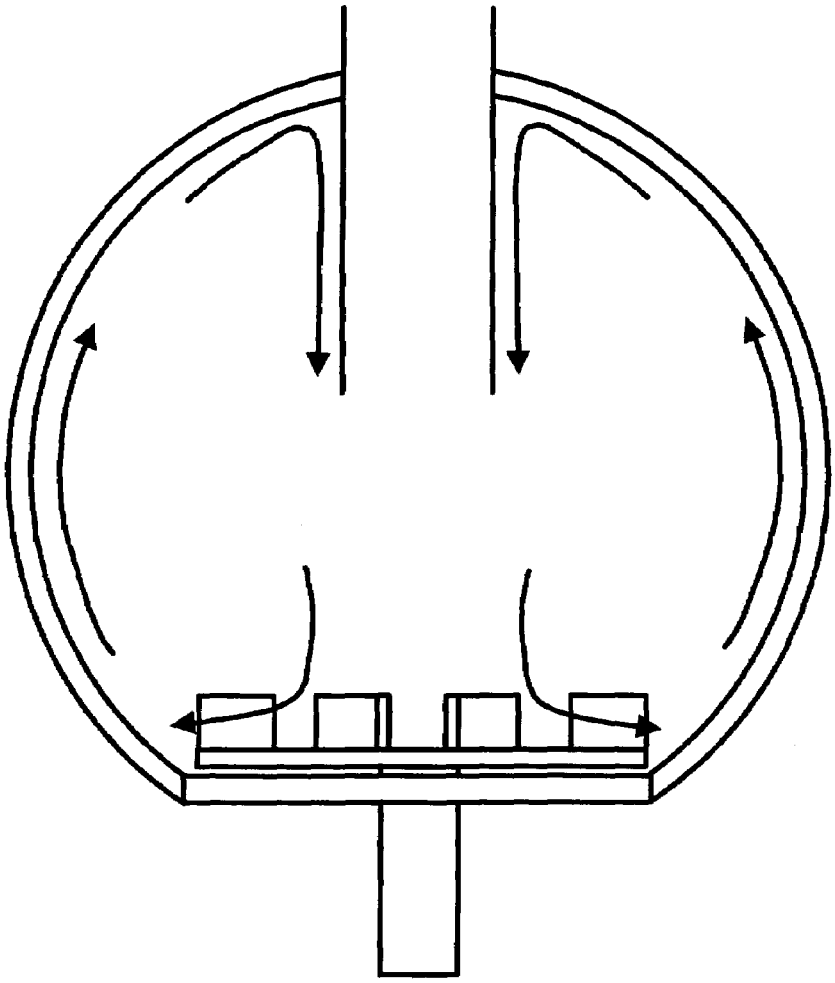
FIG. 2 is a schematic view illustrating an embodiment of the stirring tank of the stirrer in the present invention.

FIG. 2 is a schematic view illustrating a stirrer having a spheric wall, in which an arrow indicates a circulation of the powder. Based on FIG. 2, the present invention will be explained further in detail.

When two or more powders are mixed with a stirring blade in a stirrer having a spheric wall, the powder collides with the stirring blade and receives a large centrifugal force to be hit in the direction of an inner wall of the stirrer. Next, the powder reaches a top of the stirrer along the inner wall due to a high speed airstream generated by a high speed rotation of the stirring blade. Further, the powder rides on a high speed airstream descending from the top to a rotation axis of the stirring blade, and is hit thereby again.

Therefore, the powder is constantly and stably circulating in the stirrer without a stagnation on a bottom thereof, which is a drawback of a conventional vertical and cylindrical mixer, and uniformly mixed.

When a surface treatment agent and a mother toner particle is stirred and mixed based on the temperature specified by Tg in the present invention, the toner aggregation is influenced by the mixer capacity, an amount of the mixture and a peripheral speed of the bladed wheel (rotor) and it is important to fix the conditions thereof. In addition, the toner aggregation is an index showing how the surface treatment agent is fixed on the resin powder.

When a mother toner particle having an aggregation greater than 70 and, e.g., a charge controlling agent are stirred and mixed, a stirring mixer satisfying at least the conditions mentioned above can control the aggregation because the charge controlling agent works as a fluid auxiliary agent at the beginning of mixing.

A mother toner particle stirred and mixed in the stirring mixer generating the powder circulation therein as mentioned above for use in the present invention preferably has a volume-average particle diameter (Dv) of from 3 to 7.5 $\mu$m. When the Dv is less than 3 $\mu$m, the powder has too small a mass and the surface treatment agent is difficult to fix thereon with an energy imparted by the stirring blade. When the Dv is greater than 7.5 $\mu$m, the powder crashes, which changes not only the Dv after mixed but also affects the quality of the resultant toner.

A charge controlling agent mixed with a mother toner particle as a surface treatment agent therefor in the fluidizing and stirring mixer of the present invention preferably has a primary particle diameter of from 5 to 300 nm.

When the primary particle diameter is less than 5 nm, the charge controlling agent has too small a mass and floats in the stirrer, and tends to be difficult to adhere on the mother toner particle. When greater than 300 nm, the charge controlling agent has too large a cross sectional area adhering to a surface area of the mother toner particle, and is not sufficiently adhered thereto and floats occasionally, which affects the quality of the resultant toner.

The fluidizing and stirring mixer of the present invention is preferably a spheric mixer having neither projection nor concavity and convexity on its inner wall.

In a mixer having concavity and convexity on its inner wall such as a hybridizer disclosed in Japanese Laid-Open Patent Publication No. 5-34971, a mother toner particle collides with the wall, and is frictionized and heated. Therefore, a part of the mother toner particles melts and agglutinates, or a release agent is exposed therefrom, resulting in change of the toner properties.

When the mixer has a projection on its inner wall, the projection preferably has a height not greater than 1 mm, and more preferably not greater than 0.5 mm.

A surface of a mother toner particle circulating along this smooth wall at a high speed can uniformly be treated without further pulverization of the mother toner particle.

When the inner wall has a projection and is not smooth, an air turbulence tends to occur. Therefore, an extra pulverization of the mother toner particle, a local fusion thereof and a deficiency of uniformity of the surface treatment (unevenness of energy imparted between the particles) tend to occur.

The projection from the inner wall of the mixer in the present invention does not include a sensor measuring an inner temperature or a projection preventing the powder from adhering on the inner wall in the direction of an axis of the rotor.

It is preferable that the mixer is almost a sphere having no cylindrical or flat inner wall, and having a continuous curved surface. Other than this curved surface, a powder discharger and an air discharge opening, etc are not included. Such a continuous curved surface generates a stable high speed airstream without disorder and a uniformity of energy imparted to particles including a resin powder. Specific examples of such mixers include a Q-form mixer from Mitsui Mining Co., Ltd.

The stirring blade has to be rotated at a high speed to give a sufficient impact force to the powder because it is essential that the number of collision times between the blade and powder or the particles each other have to be increased and further that the particle is hit toward the inner wall with a large centrifugal force to fix the surface treatment agent on the mother toner particle.

Figure 3:
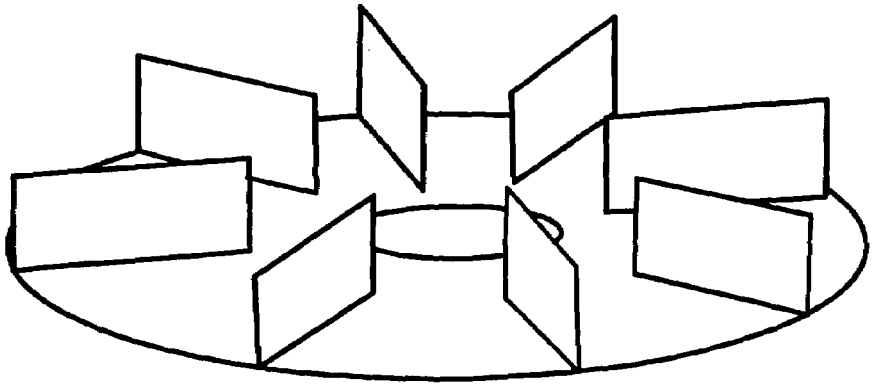
FIG. 3 is a schematic view illustrating the shape of an embodiment of the blade of the rotor included in the stirring tank of the stirrer in the present invention.

The impact force the powder receives from the blade when colliding therewith is maximum in the rotating direction thereof. Therefore, the stirring blade preferably has a shape capable of transmitting a force in the rotating direction thereof to the powder as much as possible, such as a shape shown in FIG. 3.

The blade having a flat vertical to the rotating direction thereof can impart all the impact force to the powder because the powder circulating on a high speed airstream in a fluidizing and stirring mixer for use in the present invention directly descends from the top of the mixer to the stirring blade.

Therefore, the bladed wheel having a stirring blade in a radial pattern preferably used as the rotor in the present invention can make the best of the rotational energy. In addition, the number of blades is determined by probability of collision with the powder, i.e., rotational frequency thereof and capacity of the mixer, and preferably from 4 to 12 pieces when the capacity of the mixer is from 30 to 150 litters.

In the fluidizing and stirring mixer for use in the present invention, the powder is constantly circulating. However, when a charged amount is small, most of the mother toner particles adhere on the inner wall of the mixer, and not only the stirring efficiency is not improved but also the yield point becomes small. In addition, it is probable that the resultant mixture includes unmixed mother toner particle because the mother toner particle adhered on the inner wall of the mixer is not mixed.

When the charged amount is not less than 0.2 times as much as the capacity of the mixer, self-cleaning mechanism of the mother toner particle circulating works to scrape the mother toner particle adhered on the inner wall of the mixer off. Therefore, a toner including the mother toner particle uniformly treated with a surface treatment agent can be obtained.

The charged amount is preferably from 0.2 to 0.6 times, and more preferably 0.3 times as much as the mixer capacity to uniformly circulate the powder and stir the powder most efficiently. Area of the blade is enlarged or mixing time is prolonged to further improve the stirring efficiency. When the powder is stirred and mixed at a high speed, various forces such as an impact force are applied thereto and an extra energy is released as a heat energy to increase an inner temperature of the mixer. When the inner temperature is too high, mother toner particles partly melt and a release agent is exposed from the mother toner particle, which affects quality of the resultant toner.

The mixer having a spheric wall has a double structure having a jacket outside, including a heat medium to prevent such a heat. Further, the mother toner particle hit by the blade of the bladed wheel is transported by a high speed airstream to the top of the mixer, until then the mother toner particle is cooled. Therefore, the surface treatment is efficiently performed and the treatment can be finished before the inner temperature increases.

It is preferable that the spheric wall does not have concavity and convexity to avoid friction and heat generation due to collision among the mother toner particles.

Figure 4:
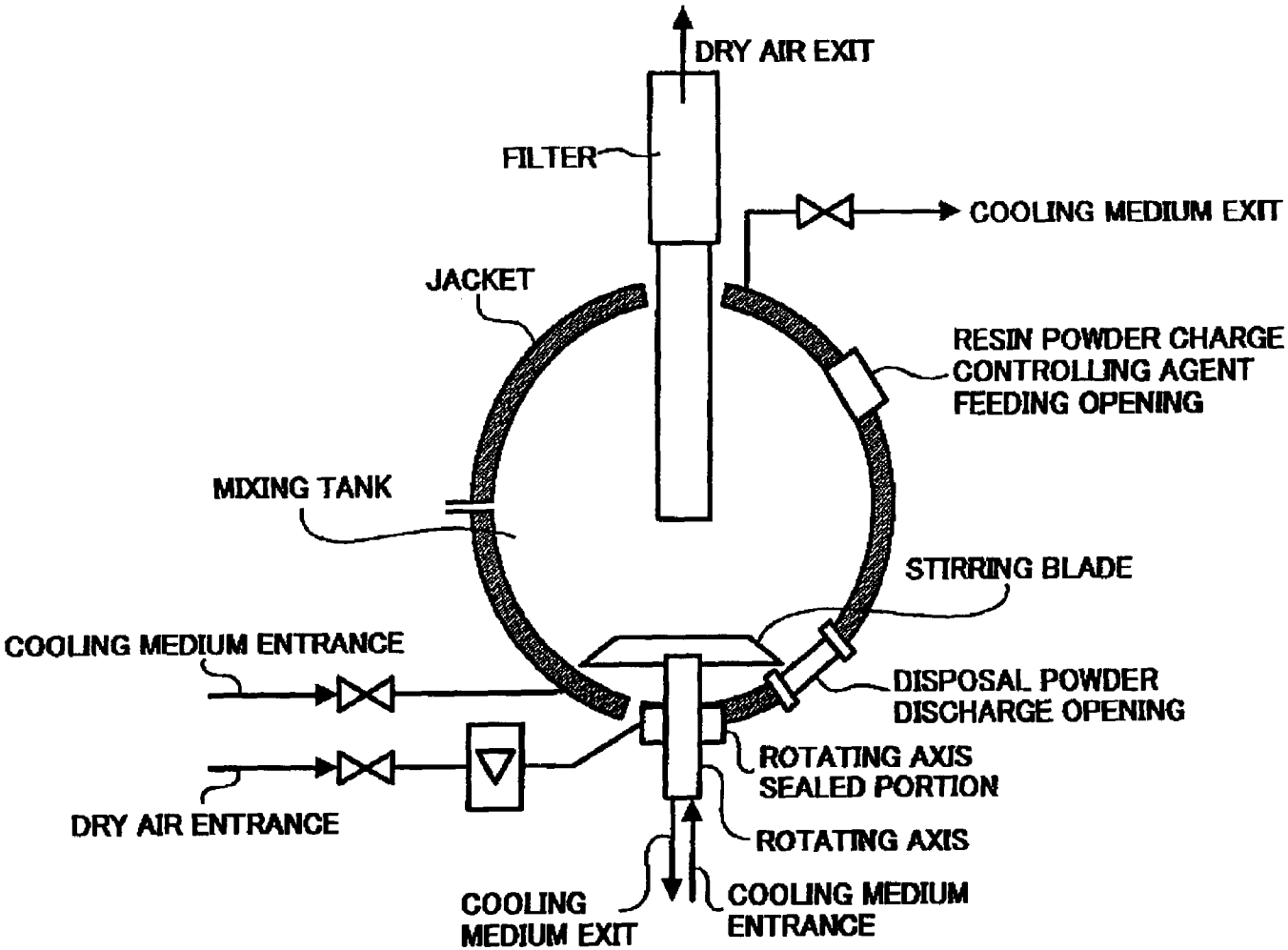
FIG. 4 is a schematic view illustrating an embodiment of the mixer equipped with a jacket for controlling an inner temperature thereof in the present invention.

In addition, as FIG. 4 shows, to prevent the mother toner particles from flowing out of the mixer from a transfixed portion of a rotating axis of the stirring blade, dry air is preferably taken in the mixer from a sealed portion of the stirring blade.

It is effective to prevent an increase of temperature by a heat generation due to a high speed stirring and mixing to stir at an environmental temperature (T° C.) such that the environmental temperature satisfies the following relationship:

$$Tg-10>T>Tg-35(^\circ C.)$$

wherein Tg represents a glass transition temperature of the binder resin.

A cooling medium having a temperature not greater than an installed environmental temperature of the mixer flown in the jacket to prevent the increase of temperature. The cooling medium preferably has a temperature of from −20 to 18° C., and more preferably from −15 to −5° C.

At a normal installed environmental temperature of the mixer, the cooling medium preferably has a temperature not greater than 15° C., and more preferably not greater than −5° C.

The cooling medium flown in the jacket cools an inner surface of the mixer to have an 5 almost same temperature as that of the cooling medium and an excessive increase of temperature of the mother toner particles can be prevented. However, a gaseous body in the mixer is also cooled to occasionally cause a condensation in the mixer according to conditions of temperature and humidity. The powder agglutinates when stirred and mixed with the condensation.

Particularly when the cooling medium has a temperature of −5° C., a cooling effect is large but a condensation tends to occur in the mixer and the mother toner particles agglutinate due to the condensation, and it is difficult to uniformly mix the powder. When the cooling medium has a temperature not less than the installed environmental temperature of the mixer, the resin powder cannot sufficiently be cooled and the temperature greater than Tg-10° C. makes it difficult to sitr and mix at a high speed.

To prevent the condensation, it is effective to stir and mix while forcibly substituting a dry gaseous body in the mixer with a dry gaseous body having a dew point less than a temperature of the cooling medium flown in the jacket. More preferably, it is further effective to use a gaseous body having a dew point less than the cooling medium temperature in the jacket minus 5° C. in an ambient pressure.

A toner can stably be produced without being affected by stirring and mixing conditions such as temperature and humidity when a gaseous body having a dew point less than the cooling medium temperature in the jacket minus 5° C. in an ambient pressure is used. The dry gaseous body preferably has a dew point less than the cooling medium temperature in the jacket minus 10° C. in an ambient pressure.

In relation to the cooling medium temperature, the dry gaseous body has a dew point at least not greater than 13° C., preferably not greater than −10° C., and more preferably not greater than −15° C.

Figure 5:
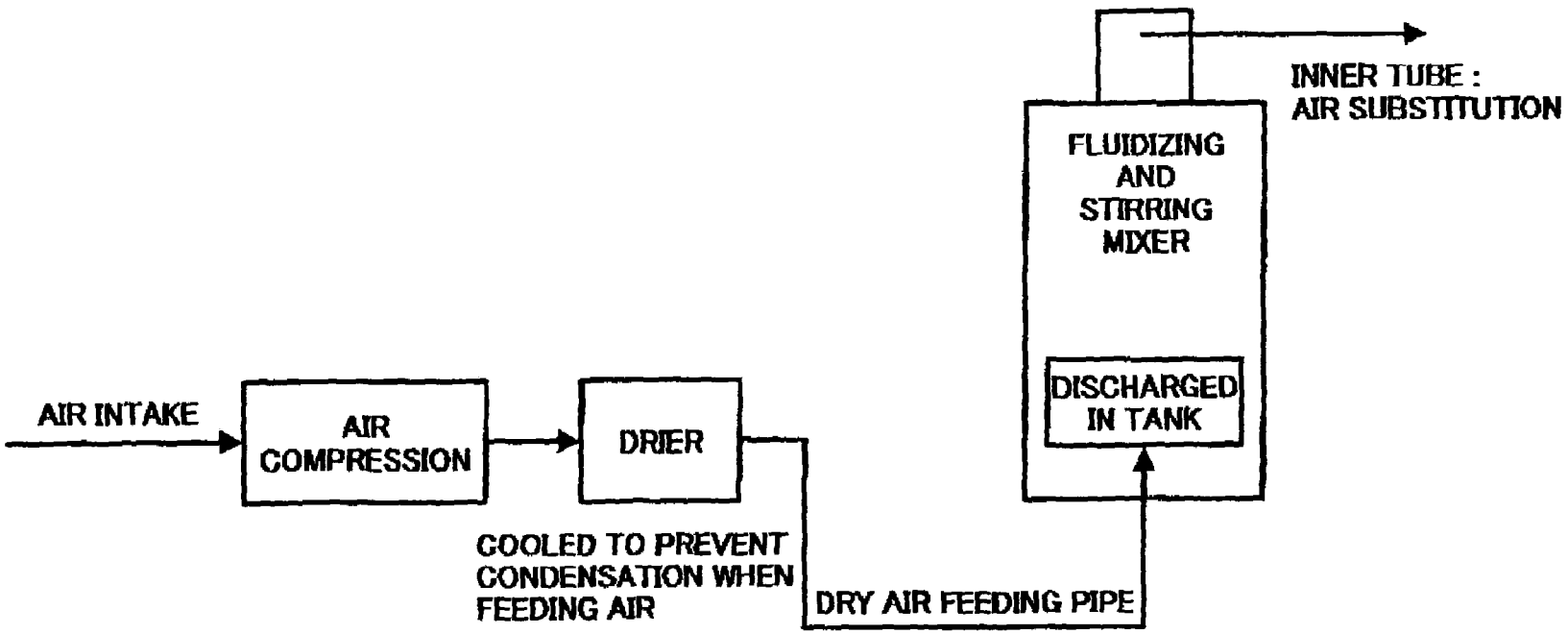
FIG. 5 is a flow chart of an embodiment of the system for controlling the dry gaseous body in the present invention.

As FIG. 5 shows, air is taken in a compressor and dried through a drier so as to have a predetermined dew point to form a gaseous body to substitute a gaseous body in the mixer.

The gaseous body after dried preferably has a temperature not greater than 15° C. so as not to affect an inner temperature of the mixer.

Methods of preparing a mother toner particle including at least a thermoplastic resin, a colorant and a release agent include a pulverization method of kneading the thermoplastic resin, colorant and release agent upon application of heat; and pulverizing and classifying the kneaded mixture; and a polymerization method of polymerizing the thermoplastic resin, colorant and a charge controlling agent by dispersing them as a grease spot in a solvent, etc.

When the mother toner particle prepared by these methods is used for a toner for electrophotography, a charge controlling agent is uniformly stirred and mixed with the mother toner particle to increase friction chargeability of the mixture and has to be firmly fixed on the mother toner particle to obtain charge stability of the mixture. A spheric mixer having a bladed wheel mentioned above is preferably used to mix the charge controlling agent with the mother toner particle. When a charge controlling agent is used as the surface treatment agent, a mixture of the mother toner particle and charge controlling agent after mixed preferably has an aggregation of from 20 to 70%, more preferably from 25 to 60% and furthermore preferably from 30 to 50% to have high chargeability.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, activators including fluorine, metal salts of salicylic acid, salicylic acid derivatives, etc. Specific examples of the marketed products of the charge controlling agents include Bontron 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group and the like; etc.

A fluid auxiliary agent has to be further mixed and adhered to the mother toner particle to improve fluidity of the mixture. A conventionally used vertical and cylindrical stirrer such as a Henschel mixer or a spheric mixer mentioned above can be used to mix and adhere the fluid auxiliary agent to the mother toner particle at a peripheral speed of from 30 to 40 m/s.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified. The fluidizing and stirring mixer and the rotor, i.e., the bladed wheel shown in FIGS. 2 and 3 respectively were used.

EXAMPLES

Example 1

In a reaction container with a condenser, a stirrer and a nitrogen introducing tube, 810 parts of polyoxyethylene (2.2)-2,2-bis(4-hydroxyphenol)propane, 300 parts of terephthalic acid and 2 parts of dibutyltinoxide were mixed and reacted for 8 hrs at 230° C. under a normal pressure. After the reaction was further performed for 5 hrs under a reduced pressure of from 10 to 15 mmHg, the reaction product was cooled to have a temperature of 160° C. and 32 parts of phthalic anhydride were added thereto to perform a reaction for 2 hrs. Then, the reaction production was cooled to have a temperature of 80° C. and mixed with 188 parts of isophorondiisocyanate in ethyl acetate and reacted for 2 hrs to prepare a prepolymer including an isocyanate group (1). Then, 267 parts of the prepolymer (1) and 14 parts of isophorondiamine were reacted at 50° C. for 2 hrs to prepare a urea-modified polyester (1) having a weight-average molecular weight of 58,000. As mentioned above, a polycondensation between 724 parts of an adduct of bisphenol A with 2 moles of ethyleneoxide and 276 parts of terephthalic acid was performed for 5 hrs at 250° C. under a normal pressure. Then the reaction was further performed for 5 hrs under a reduced pressure of from 10 to 15 mmHg to prepare an unmodified polyester (a) having a peak molecular weight of 5,000. 150 parts of the urea-modified polyester (1) and 850 parts of unmodified polyester (a) were dissolved and mixed in 2,000 parts of an ethyl acetate solvent to prepare a toner binder (1) of an ethyl acetate solution.

240 parts of the toner binder (1) of an ethyl acetate solution, 4 parts of carbon black (Regal 400R from Cabot Corp.) as a colorant and 5 parts of camauba wax having a melting point of 83° C. as a release agent were uniformly mixed and dispersed by a TK-type homomixer at 12,000 rpm and a temperature of 50° C. Then, 706 parts of ion exchanged water, 294 parts of 10% hydroxyapatite slurry (Supertite 10 from Nippon Chemical Industrial Co., Ltd.) and 0.2 parts of sodium dodecylbenzenesulfonate were uniformly dissolved in the mixture. Then, the mixture was heated to have a temperature of 50° C. and stirred by the TK-type homomixer for 10 min at 12,000 rpm. Then, the mixture was transferred into a flask having a stirring stick and thermometer and heated to have a temperature of 98° C. to remove the solvent. The mixture was further filtered, washed and dried to prepare a mother toner particle having a volume-average particle diameter of 6 $\mu$m and a glass transition temperature of 50° C.

100 parts of the mother toner particle and 0.3 parts of a charge controlling agent (E-84 from Orient Chemical Industries Co., Ltd.) having a primary particle diameter of 50 nm were mixed by a Q-form mixer, i.e., a fluidizing and stirring mixer, having a capacity of 201 from Mitsui Mining Co., Ltd. for 15 min. A charged amount of the mother toner particle and charge controlling agent was 0.3 times as much as the capacity of the mixer and a peripheral speed of a bladed wheel in the mixer was 70 m/s, and a maximum temperature therein was 35° C. while a cooling medium having a temperature of 8° C. was passed through the jacket and a gaseous body having a dew point of 3° C. was fed therein by 3 litters/min. The room temperature was 25° C.

The inner maximum temperature of the mixer reached 35° C. in 5 min, and the mixer was cooled twice for 1 min and mixing was repeated three times. Therefore, the mixing process took 17 min.

Comparative Example 1

The procedures of preparation for a toner in Example 1 were repeated except for changing the peripheral speed of the bladed wheel to 45 m/s.

Comparative Example 2

The procedures of preparation for a toner in Example 1 were repeated except for changing the peripheral speed of the bladed wheel to 123 m/s, but the mixer vibrated so violently that the operation stopped on the way.

Example 2

The procedures of preparation for a toner in Example 1 were repeated except for changing the Q-form mixer into a Henschel mixer having a capacity of 201 from MITSUI MIIKE MACHINERY Co., Ltd.

Example 3

The procedures of preparation for a toner in Example 1 were repeated except for changing the peripheral speed of the bladed wheel to 90 m/s.

Comparative Example 3

The procedures of preparation for a toner in Example 1 were repeated except for changing the peripheral speed of the bladed wheel to 90 m/s and the maximum temperature in the mixer to 45° C.

Comparative Example 4

The procedures of preparation for a toner in Example 1 were repeated except for changing the peripheral speed of the bladed wheel to 90 m/s and the maximum temperature in the mixer to 10° C.

Example 4

The procedures of preparation for a toner in Example 3 were repeated except for changing the charged amount to 0.7 times.

Example 5

The procedures of preparation for a toner in Example 3 were repeated except for changing the volume-average particle diameter to 10 μm.

Example 6

The procedures of preparation for a toner in Example 3 were repeated except for changing the primary particle diameter of the charge controlling agent to 500 nm.

Example 7

The procedures of preparation for a toner in Example 3 were repeated except for changing the cooling medium temperature to −5° C. and the maximum temperature in the mixer to 10° C.

The inner maximum temperature of the mixer reached 10° C. in 1.5 min, and the mixer was cooled 4 times for 2 min and mixing was repeated 5 times. Therefore, the mixing process took 23 min.

Example 8

The procedures of preparation for a toner in Example 3 were repeated except for changing the cooling medium temperature to 15° C.

Example 9

The procedures of preparation for a toner in Example 3 were repeated except for changing the cooling medium temperature to 20° C.

Example 10

The procedures of preparation for a toner in Example 3 were repeated except for changing the cooling medium temperature to −5° C., the dew point of the gaseous body to −15° C. and the maximum temperature in the mixer to 10° C.

The inner maximum temperature of the mixer reached 10° C. in 3 min, and the mixer was cooled 4 times for 1 min and mixing was repeated 5 times. Therefore, the mixing process took 19 min.

Example 11

The procedures of preparation for a toner in Example 10 werer repeated except for changing the dew point of the gaseous body to −10° C.

Example 12

The procedures of preparation for a toner in Example 10 were repeated except for changing the dew point of the gaseous body to −5° C.

Aggregation rate of the toner prepared in each Example and Comparative Example was determined as follows.

Sieves having openings of 75, 45 and 22 μm were sequentially stacked and a vibration let 2 g of a sample naturally fall.

$a$=(a sample weight remaining on the upper stacked sieve)/2 g×100

$b$=(a sample weight remaining on the middle stacked sieve)/2 g×(3/5)×100

$c$=(a sample weight remaining on the lower stacked sieve)/2 g×(1/5)×100

The aggregation rate=a+b+c(%)

In addition, how the charge controlling was present on a surface of the toner was observed by a SEM.

○: completely fixed

Δ: partly fixed

X: free

The results are shown in Table 1

TABLE 1

| | Aggregation rate (%) | SEM observation |
|---|---|---|
| Example 1 | 25 | ○ |
| Example 2 | 60 | Δ |
| Example 3 | 30 | ○ |
| Example 4 | 10 | Δ |
| Example 5 | 12 | Δ |
| Example 6 | 10 | Δ |
| Example 7 | 4 | ○ |
| Example 8 | 6 | ○ |
| Example 9 | 7 | ○ |
| Example 10 | 5 | ○ |
| Example 11 | 4 | ○ |
| Example 12 | 5 | ○ |
| Comparative Example 1 | 10 | X |
| Comparative Example 2 | Not available | — |
| Comparative Example 3 | 82 | Δ |
| Comparative Example 4 | 10 | X |

100 parts of each toner and 0.1 parts of hydrophobic silica were mixed by a Henschel mixer. 4% by weight of each mixture and 96% by weight of a copper-zinc ferrite carrier coated with a silicone resin having an average particle diameter of 50 μm were mixed to prepare a developer. Each of the developer was set in a copier imagio Neo 450 capable of producing 45 pieces of A4 size images a minute and 100,000 and 200,000 images were continuously produced to evaluate the following items. The results are shown in Table 2 and 3 respectively.

(Evaluation Items)

(a) Charged Amount Adherence Index of Charge Controlling Agent 6 g of the developer was charged into a metallic cylinder capable of being sealed and blown to measure a charged amount thereof. The developer had a toner concentration of from 4.5 to 5.5% by weight.

(b) Background Fouling Index of (Charging Uniformity)

A developer on the photoreceptor after a white image is developed was transferred onto an adhesive-tape. A difference of image density between the adhesive-tape on which the developer was transferred and an adhesive-tape on which the developer was not transferred was measured by a 938 spectrodensitometer from X-Rite, Inc.

(c) Spent Rate (Bleed Index From Toner)

The toner was removed from the developer by a blow-off method after 100,000 images were produced to measure the weight of the remaining carrier W1. The carrier was included in toluene to dissolve the soluble material, and washed and dried to measure the weight W2. The spent rate was determined by the following formula.

$$\text{Spent rate}=((W1-W2)/W1)\times 100$$

⊙: 0 to 0.01 wt %

○: 0.01 to 0.02 wt %

Δ: 0.02 to 0.05 wt %

X: greater than 0.05 wt %

(d) Filming (Surface Fixation Index)

Occurrence of toner filming over a developing roller or a photoreceptor was observed.

○: No toner filming

Δ: Striped filming

X: Filming entirely

TABLE 2

| | Start | | After 100,000 images were produced | | | | |
|---|---|---|---|---|---|---|---|
| | Charged amount (−μC/g) | Background fouling | Charged amount (−μC/g) | Background fouling | Spent rate | Filming | Comprehensive evaluation |
| Ex. 1 | 28 | ○ | 27 | ○ | ○ | ○ | ○ |
| Ex. 2 | 25 | Δ | 23 | Δ | X | Δ | Δ |
| Ex. 3 | 30 | ○ | 30 | ○ | ⊙ | ○ | ⊙ |
| Ex. 4 | 22 | Δ | 22 | Δ | Δ | ○ | Δ |
| Ex. 5 | 25 | Δ | 24 | X | Δ | Δ | Δ |
| Ex. 6 | 25 | ○ | 20 | X | Δ | Δ | Δ |
| Com. Ex. 1 | 20 | X | 15 | X | X | X | X |
| Com. Ex. 2 | — | — | — | — | — | — | XX |
| Com. Ex. 3 | 26 | | 24 | X | X | X | X |
| Com. Ex. 4 | 22 | X | 13 | X | X | X | XX |

TABLE 3

| | Start | | After 200,000 images were produced | | | | |
|---|---|---|---|---|---|---|---|
| | Charged amount (−μC/g) | Background fouling | Charged amount (−μC/g) | Background fouling | Spent rate | Filming | Comprehensive evaluation |
| Ex. 3 | 30 | ○ | 25 | ○ | ○ | ○ | ○ |
| Ex. 7 | 32 | ○ | 30 | ○ | ○ | ○ | ○ |
| Ex. 8 | 29 | ○ | 28 | ○ | ○ | ○ | ○ |
| Ex. 9 | 25 | ○ | 21 | Δ | Δ | Δ | Δ |
| Ex. 10 | 32 | ○ | 30 | ○ | ⊙ | ○ | ⊙ |
| Ex. 11 | 30 | ○ | 29 | ○ | ⊙ | ○ | ⊙ |
| Ex. 12 | 29 | ○ | 26 | ○ | Δ | Δ | ○ |

It is apparent from Table 2 that:

Example 1, and Comparative Examples 1 and 2 show that a proper peripheral speed increases the fixation efficiency;

Examples 1 and 2 shows that the spheric mixer of the present invention has quite a higher fixing capability than the Henschel mixer;

Example 3, and Comparative Examples 3 and 4 show that a proper process temperature increases the fixation efficiency;

the toner in Example 4 has a low charged amount because the charge controlling agent is not sufficiently fixed on some of the toners;

the resin powder having a large volume-average particle diameter in Example 5, which was pulverized by stirring and mixing, deteriorated background fouling; and the charge controlling agent having a large primary particle diameter in Example 6 was released from the resin powder deteriorated background fouling and filming.

This document claims priority and contains subject matter related to Japanese Patent Application No. 2002-234643 filed on Aug. 12, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of producing a toner composition, comprising:

providing a fluidizing and stirring mixer comprising a spherically walled portion and a rotor having a stirring blade; and stirring and mixing toner particles comprising a binder resin, a colorant and a release agent with a charge controlling agent in the spherically walled portion of the fluidizing and stirring mixer to fix the charge controlling agent on the toner particles, wherein the stirring and mixing comprises rotating the rotor at a peripheral speed of from 65 to 120 m/s at an environmental temperature (T) in the fluidizing and stirring mixer, satisfying the following relationship:

$$Tg-10>T>Tg-35\ (^\circ\ C.)$$

where the Tg represents a glass transition temperature of the binder resin.

2. The method of claim 1, wherein the fluidizing and stirring mixer further comprises a jacket configured to control an inner temperature thereof with a cooling medium.

3. The method of claim 2, wherein the cooling medium has a temperature of from −20 to 19° C.

4. The method of claim 1, wherein the stirring blade comprises a sealed portion configured to take in a first gaseous body to forcibly substitute a second gaseous body in the fluidizing and stirring mixer therein.

5. The method of claim 4, wherein the first gaseous body has a dew point less than a temperature of the cooling medium in the jacket minus 5° C. in an ambient pressure.

6. The method of claim 1, wherein the stirring and mixing are performed while the toner particles are in an amount of from 0.2 to 0.7 times a capacity of the fluidizing and stirring mixer.

7. The method of claim 1, wherein the toner particles have an average particle diameter of from 3 to 7.5 $\mu$m.

8. The method of claim 1, wherein the charge controlling agent has a primary particle diameter of from 5 to 300 nm.

9. The method of claim 1, wherein each of the toner particles and the charge controlling agent has an aggregation rate of from 20 to 70%.

10. The method of claim 1, wherein the rotor is a bladed wheel having plural radial stirring blades.

11. The method of claim 1, wherein the fluidizing and stirring mixer further comprises an interpolation tube vertically penetrating the fluidizing and stirring mixer.

* * * * *